US007007330B2

(12) United States Patent
Kuiper et al.

(10) Patent No.: US 7,007,330 B2
(45) Date of Patent: Mar. 7, 2006

(54) PORTABLE PATIENT TURNING AND LIFTING DEVICE

(75) Inventors: Hendrik Klass Kuiper, Edwards, MS (US); Danny Earl Ellis, Utica, MS (US); Bobby E. Reed, Vicksburg, MS (US)

(73) Assignee: AutoNurse, Inc., Vicksburg, MS (US)

( * ) Notice: Subject to any disclaimer, the term of this patent is extended or adjusted under 35 U.S.C. 154(b) by 265 days.

(21) Appl. No.: 10/010,870

(22) Filed: Dec. 7, 2001

(65) Prior Publication Data

US 2002/0133877 A1 Sep. 26, 2002

Related U.S. Application Data

(63) Continuation-in-part of application No. 09/733,361, filed on Dec. 8, 2000, now abandoned.

(51) Int. Cl.
*A61G 7/057* (2006.01)

(52) U.S. Cl. ..... 5/715; 5/615; 5/731; 5/732; 5/733; 5/713

(58) Field of Classification Search ..... 5/609, 5/615, 710–715, 731–734
See application file for complete search history.

(56) References Cited

U.S. PATENT DOCUMENTS 1,772,310 A * 8/1930 Hart ..... 5/713
3,477,071 A 11/1969 Emerson
3,492,988 A 2/1970 De Mare
4,134,168 A 1/1979 Guigan
4,697,290 A 10/1987 Alklind et al.
4,797,962 A 1/1989 Goode
4,858,262 A 8/1989 Anderson
4,941,221 A 7/1990 Kanzler
4,947,500 A 8/1990 Seiler
4,949,412 A 8/1990 Goode
4,977,629 A 12/1990 Jones
4,986,738 A 1/1991 Kawasaki et al.
5,048,123 A 9/1991 Monson
5,086,529 A 2/1992 DeGroot
5,103,511 A 4/1992 Sequin
5,142,720 A 9/1992 Kelso et al.
5,168,589 A 12/1992 Stroh et al.
5,323,500 A 6/1994 Roe et al.
5,331,698 A 7/1994 Newkirk et al.
5,394,577 A 3/1995 James et al.

(Continued)

OTHER PUBLICATIONS

Progressive Medical, Inc. web site, pp. 1-2 and pp. 1-5.

*Primary Examiner*—Michael Trettel
(74) *Attorney, Agent, or Firm*—Kirkpatrick & Lockhart Nicholson Graham LLP

(57) ABSTRACT

The present invention provides a portable patient turning and lifting device and associated methods for turning and lifting an immobilized patient. The device comprises at least one inflation bladder configured to be secured between the patient's body and the patient supporting surface, such as a bed. The bladder is inflated with pressurized fluid. Preferably, the inflation bladder is secured by a body support having at least one support pad on which the patient is positioned. An embodiment provides two inflatable turning bladders oriented on the left and right sides of the back of the body support. Preferably, at least one fluid pump is provided in communication with the bladders, and it is preferably fitted with a controller to tailor the sequencing and timing of the inflation to reposition the patient's body.

8 Claims, 9 Drawing Sheets

U.S. PATENT DOCUMENTS 5,487,196 A 1/1996 Wilkinson et al.
5,509,155 A 4/1996 Zigarac et al.
5,528,783 A 6/1996 Kunz et al.
5,594,963 A 1/1997 Berkowitz
5,658,050 A 8/1997 Lorbiecki
5,687,438 A 11/1997 Biggie et al.
5,701,622 A 12/1997 Biggie et al.
5,745,942 A 5/1998 Wilkerson
5,755,000 A 5/1998 Thompson
5,774,917 A 7/1998 Liu
5,781,949 A * 7/1998 Weismiller et al. ..... 5/715
5,815,862 A 10/1998 Rygiel
5,911,612 A 6/1999 Steger
5,926,883 A * 7/1999 Rechin et al. ..... 5/706
5,926,884 A 7/1999 Biggie et al.
5,947,168 A 9/1999 Viard
5,956,787 A 9/1999 James et al.
5,966,762 A * 10/1999 Wu ..... 5/710
5,970,550 A 10/1999 Gazes
6,009,873 A 1/2000 Neviaser
6,014,784 A 1/2000 Taylor et al.
6,032,299 A 3/2000 Welsh
6,079,070 A * 6/2000 Flick ..... 5/715
6,085,372 A 7/2000 James et al.
6,108,843 A 8/2000 Suzuki et al.
6,115,860 A 9/2000 Vrzalik
6,119,292 A 9/2000 Haas
6,154,900 A 12/2000 Shaw
6,182,316 B1 2/2001 Thomas et al.
6,216,294 B1 4/2001 Wess
6,217,257 B1 4/2001 Garofalo et al.
6,240,584 B1 6/2001 Perez et al.
6,279,162 B1 8/2001 Silverthorn
6,282,737 B1 9/2001 Vrzalik
6,353,950 B1 * 3/2002 Bartlett et al. ..... 5/617

* cited by examiner

PORTABLE PATIENT TURNING AND LIFTING DEVICE

RELATED APPLICATIONS

This application is a continuation-in-part of application Ser. No. 09/733,361, filed Dec. 8, 2000, now abandoned.

FIELD OF THE INVENTION

The present invention pertains to devices and methods for the prevention and treatment of wounds of patient immobility.

BACKGROUND OF THE INVENTION

Prevention of wounds associated with immobility and promoting of healing of existing wounds on an immobilized or bedridden patient can be a resource consuming challenge for healthcare providers. Undesirable pathological side effects can result from a patient's bedridden condition which health care providers must attempt to avoid during the patient's immobilization. Of primary concern are pressure ulcers, or bedsores, which result from extended contact between pressure points along the patient's body and the supporting surface, such as a bed mattress. The weight of the patient on these contact areas serves to compress the tissue in these areas. The areas of compressed tissue experience reduced blood circulation. The lack of oxygenated blood can lead to death of cells in the compressed region of tissue. A pressure ulcer may first appear as an area of non-blanch able erythematic and may progress to a deep crater wound that can involve muscle, bone and joints. These wounds typically develop over a bony prominence due to the interface with the patient supporting surface. Left untreated, pressure ulcers can lead to sepsis, which can cause death.

Pressure ulcers can be caused not only by pressure forces against tissue, but also by forces of shear, friction, or maceration applied to the tissue of patient, alone or in combination. These other forces may be generated anytime force is applied to the patient or bed tending to move them relative to each other while contact between the patient and surface, tending to hold the tissue, remains.

Also, if the patient has injuries on or adjacent to the contact areas of tissue, the reduced blood circulation at those pressure points can interfere with the proper healing of those injuries. In short, any medical condition that immobilizes a patient, temporary or chronic, can ultimately lead to the localized circulation problems described above. Any condition that decreases a patient's ability to make positional changes can cause the patient to be easily susceptible to the wounds of immobility.

To alleviate the potential for formation of pressure ulcers or wounds on an immobilized patient, it has been common practice to periodically move the position of the patient's body (typically in bed) so that the pressure of the patient's weight is relieved from the current tissue pressure points and shifted to new pressure points so that blood flow can resume in the formerly pressurized areas. A complication of moving the patient to a new position in the bed is that the immobilized patient cannot exert him or herself to help move their own body. Therefore, the healthcare provider must frequently move the entire patients weight of the patient alone, which can be a difficult task that presents the risk of exertion related injuries to the health care worker. Also, movement of the patient relative to the bed without fully lifting the body from the bed can leave tissue areas under high shear and frictional forces, which cause pressure ulcers. In a large healthcare facility with multiple immobilized patients, manually moving the position of the bedridden patients can consume a significant portion of the healthcare staff's time. Additionally, a patient may have additional injuries or complications requiring special positioning such that certain areas of the body do not experience the pressure of the patient's weight. It may be difficult to manually move the patient's body to the ideal position for proper healing and patient comfort.

Various mechanisms are available for assisting healthcare providers and alleviating the effects of sustained active pressure points on an immobilized patient's body. Patient turning beds provide a patient supporting surface that is capable of rotating about a longitudinal axis of the bed from side-to-side, out of the horizontal plane. The rotation serves to shift the patient's body weight from one side to another in an effort to help reduce the effects of localized tissue pressure points on the patient's body where it meets the supporting surface of the bed. U.S. Pat. No. 5,103,511 (Sequin) discloses such an oscillatory bed.

There are several shortcomings in the use of the turning bed. The patient must be secured in the oscillatory bed so that he or she does not roll out of the bed when it is rotated to a plane that defines an angle away from the horizontal. The bed does not serve to change the position of the patient's body within the bed but only serves to relieve pressure forces on the half of the patient's body above the horizontal plane. With the patient's body still in contact with the supporting surface shear and frictional forces are still exerted on the patient's tissue and may be increased as the patient's body tends to slide across the inclined surface of the turned bed. Additionally, the areas of the body that can be relieved of pressure are limited only to a portion, which lies above the horizontal plane when the bed is rotated.

Another disadvantage of the turning bed is that it requires a substantial expense in equipment and that an entire specialized bed must be obtained (rented, leased, purchased etc.). A patient must be in a facility that has such a bed and must be moved into the specialized bed in order to use it, which can be difficult for the immobilized patient and time consuming for the staff. Furthermore, because the entire bed is not easily moved, accommodations for immobilized patients are limited to where such beds can be located. In instances of patient care to be given in the patient's home, a large mechanical turning bed may not be able to fit in a small sized home. Another potential issue experienced with some turning beds is a restrictive patient weight limitation.

Another type of specialized bed intended to minimize pressure ulcers is marketed under the name Clinitron®. This type of bed utilizes a base tub of silicone beads with a protective containment covering on top. Air is blown from the bottom upward through the sand to cause the sand to flow and create a fluid-like supporting surface. The patient lies on the protective top covering supported by the bed of fluidized sand. Although the Clinitron approach may tend to equalize the compressive forces across all points of the patient's body, because body contact is maintained with the supporting surface, shear and frictional forces can still exist, which can lead to pressure ulcers.

U.S. Pat. No. 5,774,947 (Liu) discloses a turning mattress formed from inflatable bladders, each having a right and left cell separated by a central diaphragm. The left and right sides of the bladders can be alternately inflated to rotate the patient's body away from the horizontal plane to unweigh that portion of the patient's body which lies above the horizontal plane in the manner of the turning mattress described above. Because the turning mattress is used on a hospital bed, the portability issues raised above in connection with the above-described turning bed still exist. Also, as mentioned above, the turning mattress serves to move the patient only by rotation about a single longitudinal axis and does not serve to lift the patient away from the support surface. Therefore, bony prominences susceptible to pressure ulcers, remain in contact with the supporting surface and forces are translated to the tissue.

U.S. Pat. No. 4,986,260 (Iams et al.) and U.S. Pat. No. 6,014,784 (Taylor et al.) disclose pads having multiple inflatable bladders controlled to provide a continuously movable surface upon which an immobilized patient's body can rest. The movement of the inflatable bladder surfaces addresses the problem of continuous pressure at tissue pressure points on the body. An additional problem with devices using multiple bladders is that the patient's body can slip between the bladders diminishing the intended effectiveness of the device and potentially creating discomfort for the patient. Also, the disclosed devices do not operate to turn and reposition the patient's body.

SUMMARY OF THE INVENTION

The present invention provides a portable patient turning and lifting device that turns and lifts a bedridden patient from a patient supporting surface such as a bed to relieve pressure on critical tissue areas susceptible to pressure ulcers. Because the patient is turned by lifting, contact with the patient supporting surface is discontinued, avoiding the deleterious effects of shear, friction and maceration forces that may be generated on the tissue if contact were not discontinued. The device is fully portable, easy to use by a caregiver, and requires no specialized equipment to operate.

The device is defined by a body support configured to be positioned between a patient supporting surface, such as a bed and at least a portion of the body of the patient that is immobilized and in need of repositioning. The body support comprises one or more inflatable turning bladders configured to lift and turn the patient, and one or more support pads to hold the patient and keep the turning bladders effectively positioned between the patient and the patient supporting surface.

On the back side of the body support is provided at least one inflatable turning bladder. In an illustrative embodiment of the invention, left and right inflation bladders are provided on the body support positioned to correspond with lift the left and right sides of the torso. The turning bladders may be any shape capable of safely lifting the patient's body from the surface of the patient support surface. In one embodiment, the turning bladder extends the length of the body support and have a triangular cross-section to form turning bladders. The turning bladders may be secured directly to the back of the body support by bonding or may be removable retained in pockets formed on the back of the body support.

The top of the body support comprises one or more support pads. Among the support pads may be provided a backpad on which the back of the patient's torso is positioned. Extending along the sides of the backpad are side rails. The side rails rise above the backpad by several inches to provide lateral support to the torso. The backpad is of a width to space the siderails just far enough a part to accept a patients'torso. The close fit of the siderails against the sides of the torso helps to maintain the patient in position, laterally, relative to the body support. The backpad and side rails may be formed from any padding material capable of providing support to the body, such as foam or they may comprise inflatable bladders. Inflatable bladders provide the advantage of being deflated to a lower profile so that the body support may be positioned under an immobilized patient.

Additionally, at the bottom of the backpad a saddle support pad may be provided that is configured to present an elevated or inclined surface against which the thighs and buttocks of the patient may rest to prevent longitudinal sliding of the patient relative to the body support. Such downward sliding can occur when the patient's head and upper torso is elevated in a hospital bed during meal times, visiting or evaluation by a physician. The saddle presents an inflated profile that is higher than the backpad. The saddle presents a surface against which the lower portion of the body is supported from movement when the upper portion of the body is elevated on an inclined surface. In this manner the saddle operates as a chock to stop the patient's body from sliding downward. In an illustrative example of the body support, the saddle is configured as a turning bladder, presenting an inclined surface to the buttocks and back of the thighs. The saddle also serves to help elevate the sacrum from the patient supporting surface. As with the other support pads, the saddle also may be a static pad, formed from a material such as foam or it may be an inflatable bladder. If inflatable, the saddle may be inflated and deflated in sequence with the left and right inflation bladders to maintain a continuously dynamic rolling motion of the torso so that the base of the sacrum does not touch the patient supporting surface as the left and right bladders alternately inflate and deflate. Also it is noted that the backpad, siderails and saddle need not be separate components, but may be contoured portions of a single component pad, or bladder.

Because the patient is securely positioned within the body support by support pads, with little relative motion between the body support and patient body permitted, shear and frictional forces are avoided to more effectively avoid pressure ulcer development. Additionally, the secure fit of the body support around the patient keeps the patient properly oriented over the left and right inflation bladders and saddle so that the body is properly moved to avoid pressure ulcers.

Though the patient body support is configured to hold the patient in place relative to the support, the support itself can slide relative to the patient supporting surface. Any patient supporting surface that can be arranged to incline the patient presents a potential problem for patient turning devices in that gravity will tend to cause the patient to slide relative to the turning equipment. Because it is undesirable to restrain the patient to the supporting surface, the patient will slide and become mispositioned relative to the turning equipment. Rather than attempting to resist the tendency of a patient to slide on an inclined supporting surface due to gravity, the present invention focuses on keeps the patient from sliding relative to the body support though the body support may slide relative to the patient supporting surface.

All the inflation bladders of the body support are flexible, expandable and individually inflatable with any convenient fluid, such as air. The body support inflation bladders may be made from a durable, but flexible material that is reusable or may be made from lightweight, inexpensive materials to be disposable. The bladders may be permanently bonded to the body support or releasably secured to the body support by means such as placement in specially fitted pockets of the body support so that the bladders can be easily removed for replacement or for cleaning. The inflatable bladders are joined to a fluid pump system by fluid pressure lines. The pump system includes at least one fluid pump that may be manual or powered. If powered, a pump controller may be connected to the fluid pump to control its operation. A pump controller has user controls to provide a variety of inflation conditions, times and sequences. To operate left and right inflatable turning bladders, it may be desirable to provide an independent inflation pump for each bladder. One or both of the inflation pumps may be used to inflate the support pad bladders, if so equipped. Further, a suction pump may also be provided with the pump system to insure proper deflation of bladders on command.

In operation of the device, the left and right inflatable turning bladders may be alternately inflated and deflated at a selected time interval to lift the patient's body so that no given area of tissue remains compressed under the weight of the body against the patient supporting surface for an extended period of time, which could result in reduced blood flow to that area. However, the inflation bladders can be inflated in a variety of sequences to position the patient's body in a specific arrangement for a specific period of time. The inflation pump may include a rapid inflation of all the bladders to facilitate administration of patient care such as bathing or toileting.

It is an object of the present invention to provide a patient turning and lifting device that is portable, reusable, and economical to purchase and maintain.

It is another object of the invention to provide a patient turning and lifting device that is easily installed to reorient the position of a patient without requiring a specialized patient supporting surface to accommodate the turning and lifting device.

It is another object of the invention to provide a patient turning and lifting device embodied in a body support that can be easily mounted by the patient, if able, or placed under the patient by a caregiver, and that is configured to reliably position one or more inflation bladders under the patient's body such that inflation of the bladders results in repositioning of the patient's body relative to a patient supporting surface.

It is yet another object of the invention to provide a method of turning and lifting a patient's body that involves placing a body support with an inflatable bladder and a support pad between the patient and supporting surface and inflating the bladders to move the patient's body relative to a patient supporting surface.

It is yet another object of the invention to provide a patient turning and lifting device that comprises at least one inflation bladder and a mechanism for securing the bladder between the patient's body and a patient supporting surface.

It is yet another object of the invention to provide a patient turning and lifting device configured to securely maintain a patient's position on the device.

It is another objective of the invention to provide an apparatus and method for lifting an immobilized patient from a support surface to avoid the occurrence of pressure wounds and to treat existing wounds.

BRIEF DESCRIPTION OF THE DRAWINGS

The foregoing and other objects and advantages of the invention will be appreciated more fully from the following further description thereof, with reference to the accompanying diagrammatic drawings wherein.

DESCRIPTION OF THE ILLUSTRATIVE EMBODIMENTS

Figure 1:
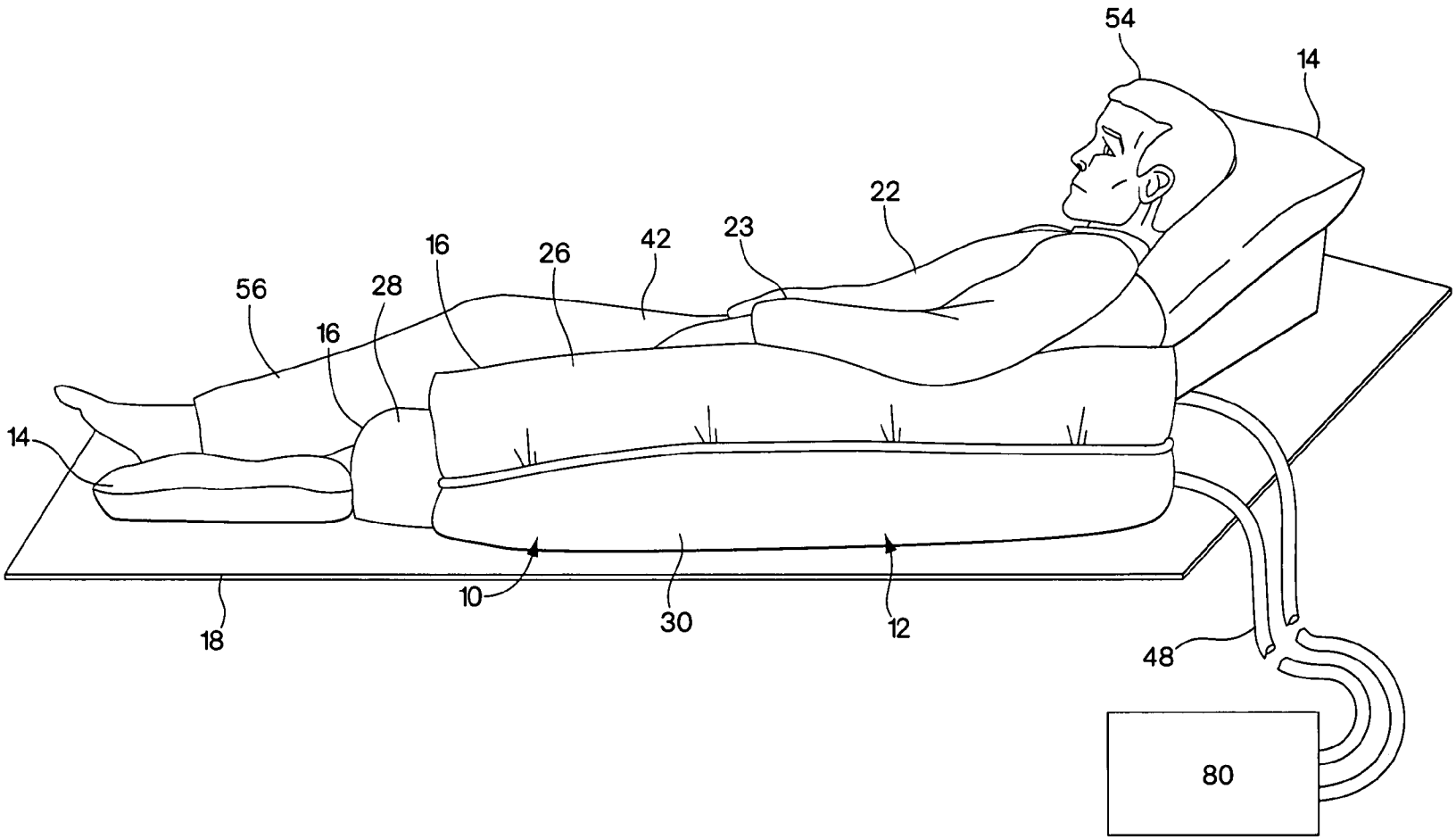
FIG. 1 is an illustration of a patient using a patient turning and lifting device of the present invention.

FIG. 1 is an illustration of a patient using an embodiment of the patient turning and lifting device of the present invention. In a preferred embodiment, the patient turning and lifting device 10 comprises a body support 12 upon which a patient 20 is positioned. The body support is configured to cradle a patient's torso 22 and is configured to hold at least one inflatable bladder 30 securely between the patient's body 20 and patient supporting surface 18. The bladders are filled by fluid that is pressurized, preferably by a pump system 80 comprising at least one pump that is in fluid connection with the bladders via fluid lines 48. The pump system is preferably provided with a controller unit to modulate its operation. In combination with a solenoid valve, the pump and controller can be set to fill and empty bladders of the body support in a variety of sequences and time intervals.

Although the patient turning and lifting device of the present invention may be configured in various ways, the inflation bladder 30 and 32 should be maintained in a position between the body 20 of the patient and a patient supporting surface 18. In this description it is to be understood that a patient supporting surface is typically a bed utilizing a mattress, but may also include any other patient supporting surface such as an examination table, floor, or supporting surfaces of a chair or wheelchair. As the inflation bladders 30 and 32 are inflated, their volume will expand to, not only turn the body of the patient, but also lift the body and reorient it relative to the support surface 18.

Figure 2:
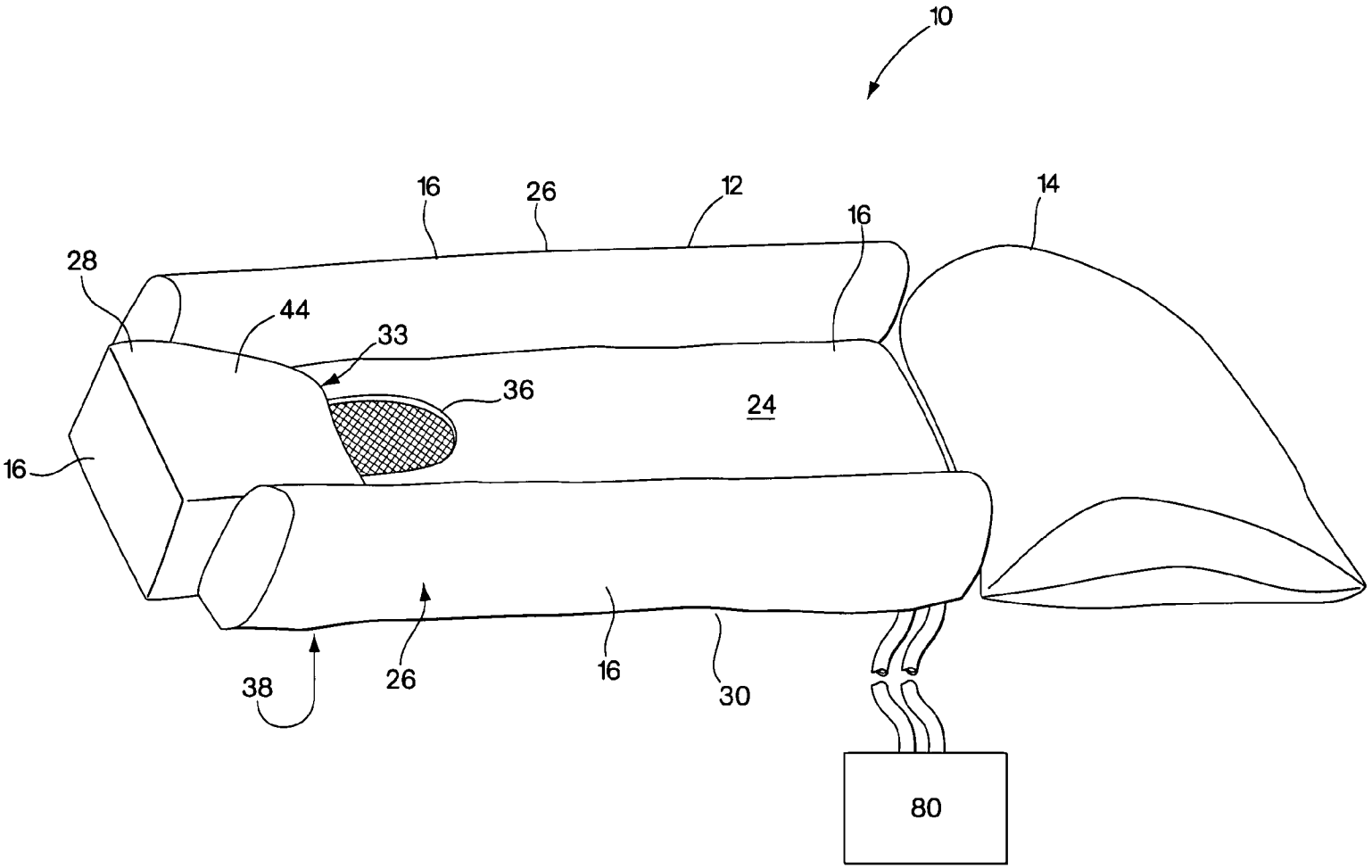
FIG. 2 is an elevated side view of a patient turning and lifting device of the present invention.
Figure 3:
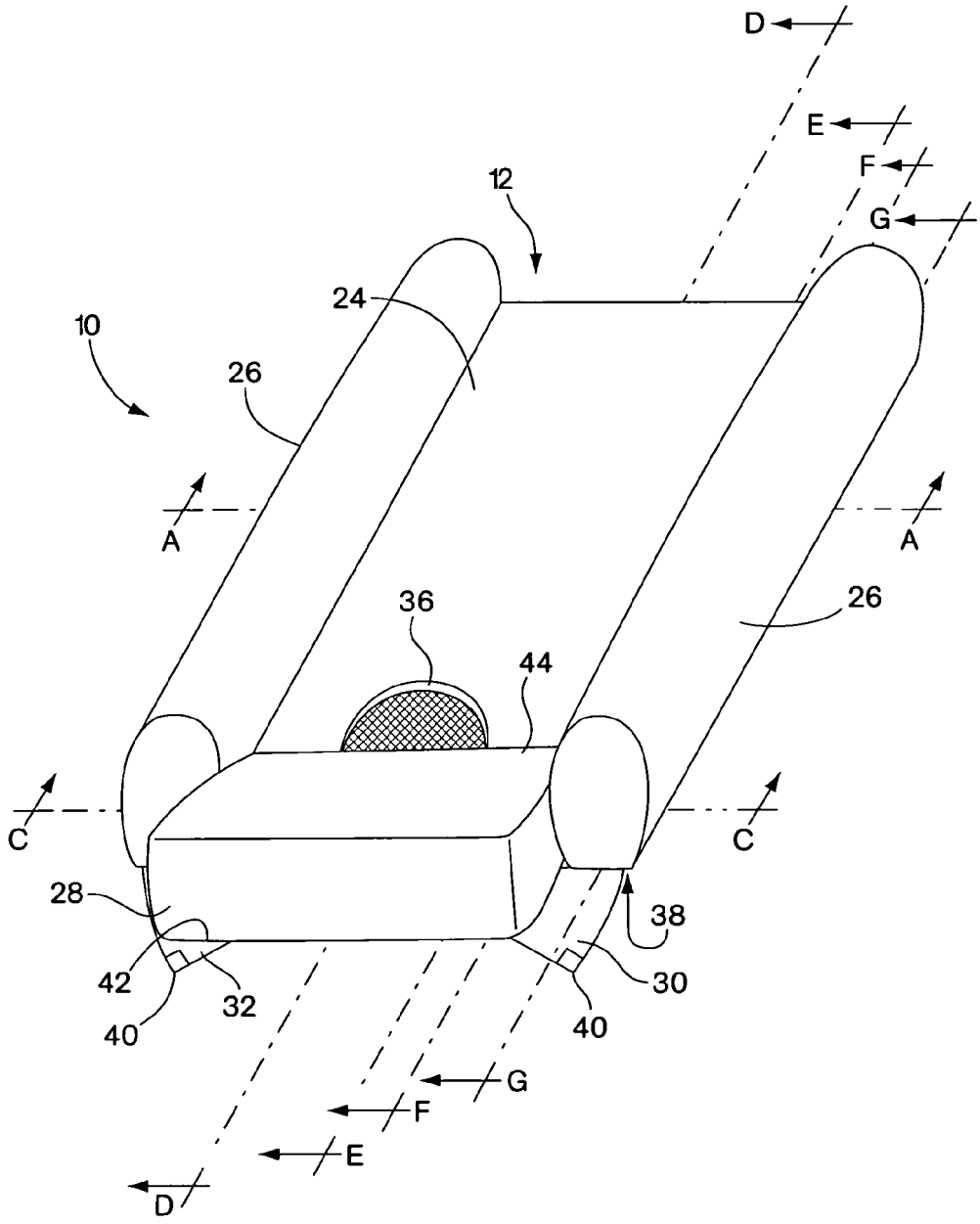
FIG. 3 is a diagrammatic illustration of a patient turning and lifting device of the present invention.

An advantage of the present invention is its portability and ease of use by a healthcare provider in applying it to a patient regardless of the type of bed the patient is using. FIGS. 1, 2 and 3 show a turning and lifting device 10 configured as a body support 12. Configuring the portable patient turning and lifting device as a body support to cradle the patient's body solves the problem of conveniently securing the means for turning the patient, in relative position between the patient 20 and supporting surface 18. In addition to the body support, the patient's body 20 is shown in FIG. 1 being supported by conventional pillows 14 at the head 54 and lower legs 56. The device 10, shown in FIGS. 1–3, provides a suitable configuration for turning and lifting an immobilized patient's torso region to avoid the occurrence of pressure ulcers.

As shown in the side views of FIGS. 1 and 2 and the diagrammatic illustration of FIG. 3, the device 10 comprises a body support having several support pads 16. A backpad 24 provides a surface of the body support on which rests the back of a patient's torso 22 while using the device. The backpad may be rectangular and need not offer and specific degree of cushion to the body, but need only provide a support surface for the torso. The backpad also provides a bottom surface 38 of the body support 12 to which turning bladders are joined. In the configuration of the body support described here, the backpad also provides a central connection point for other components in the body support system. The backpad may be a non-inflatable cushion of a material that is flexible but capable of providing support to the body, such as foam padding. However the back pad may also comprise an inflatable bladder that can be deflated for a low profile for storage or positioning of the device or inflated to elevate the torso during use of the device. After initial inflation, the backpad does not alternately inflate and deflate to turn and lift the patient. A pillow 14 for support of the patient's head 54 may be provided by the caregiver for comfort, but it is not necessary for proper function of the body support.

Extending longitudinally along the sides of the back pads are siderails 26. The siderails are a height that is several inches higher than the backpad in order to provide lateral support to the sides of the torso. The side rails may have a cross-sectional shape that is round or square or any other shape that is effective in presenting a barrier to sliding movement of the torso. The width of the backpad 24 and spacing of the siderails 26 should closely match the width of the patient's torso 22 to ensure a close fit. In use, the patient's arms 23 may rest on top of the siderails 26. Because a patient's body fits closely in the body support, there is a reduced possibility of relative movement between the body support and body during use reducing the generation of shear or frictional forces on the tissue. Like the backpad 24 described above, the siderails 26 may be either a static cushion material such as foam or may be inflatable bladders. If provided as inflatable bladders, the siderails do not alternately inflate and deflate to turn the patient after initial inflation as do the turning bladders. Rather, the siderails remain inflated to serve as a barrier to hold the patient in position relative to the body support while other inflation bladders serve the role of turning the patient.

At the lower edge 33 of the body support 12 is provided a saddle support pad configured to present a raised surface compared to the back pad that serves to catch and hold the buttocks and thighs of a patient using the device. The raised saddle prevents the patient from sliding downward relative to the body support, if the head and upper torso of the patient become elevated such as by an adjustable hospital bed. The surface of the saddle need not be as long as the backpad and may have any cross-sectional shape that presents a raised surface capable of catching the backs of the patient's thighs and buttocks when the back of the torso is positioned on the backpad 24. For example the saddle may have a triangular cross-section that when inflated, presents a turning bladder shape with its elevated and inclined surface 44 facing the thighs and buttocks of the patient.

In addition to the saddle, backpad 24 may be configured to include a recess 36 to provide a contour to accept the shape of the buttocks of the patient using the device. The opening recess may be U-shaped, extending from the bottom edge 33 of the backpad. The recess may comprise an area of the back pad that is of a thinner thickness than the remainder of the backpad, an area that does not inflate or it may be an opening cutout from the backpad surface. If configured as an opening, the recess 36 is preferably covered with a breathable material to provide some support to the buttock region but exhibiting greater flexibility than the backpad so that the buttocks can sink into the recess 36 slightly, becoming recessed in the backpad 24 to be more fully aligned with the saddle 28. The recess 36 configured as an opening also provides drainage capability to the body support in case it becomes soiled with body fluids or food.

On the bottom 38 of the body support 12 is positioned at least one turning bladder configured to lift and turn the body support and patient relative to the patient supporting surface 18. Though provision of one bladder is feasible, in preferred embodiment, left and right turning bladders, 30 and 32 are provided that are inflatable to raise and tilt the body support 12 and the patient relative to the patient supporting surface 18 in continuous alternating fashion. Left and right inflation bladders extend along the length of the backpack 24. Though the turning bladders may be any shape capable of lifting the body support from the patient supporting surface, a turning bladder shape is preferred. Each turning bladder has a triangular cross-section and extends one-half the width of the bottom 38 of the body support. In the illustrative example, shown in FIGS. 1–3F, the cross-sectional shape of the turning bladders are a 30, 60, 90 triangle in which the perpendicular edge 40 of the triangle rests on the patient supporting surface 10 and the hypotenuse 42 of the triangle is joined to the underside 38 of the body support.

Figure 3A:
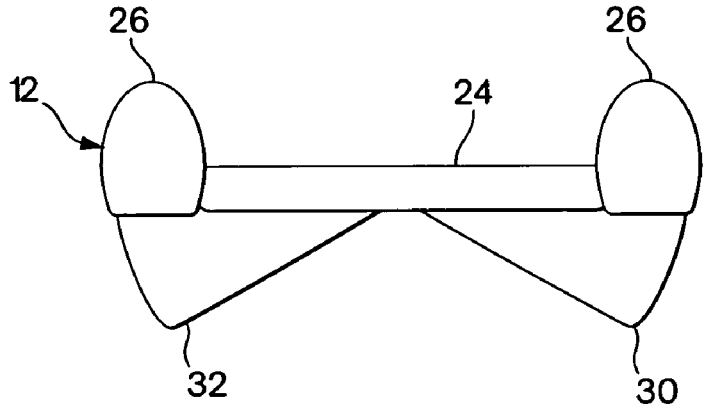
FIGS. 3A–3G are sectional views taken from FIG. 3.
Figure 3B:
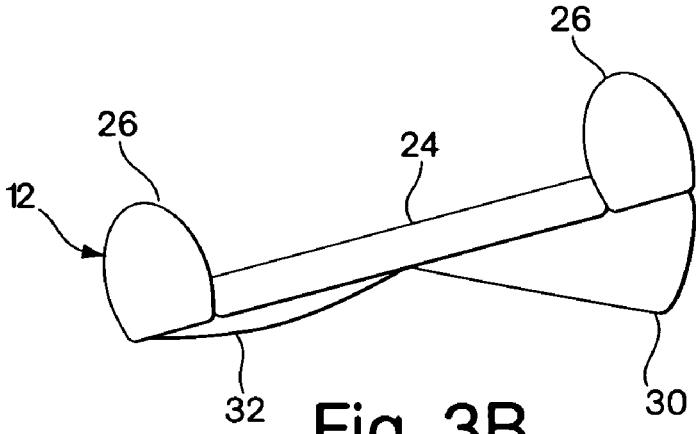

As shown in FIG. 3A taken along the sectional line A—A of FIG. 3, the left and right turning bladders 30 and 32 can be inflated together to elevate the entire body support. However to cyclically turn the patient from side to side, the left and right turning bladders are alternately inflated and deflated to tilt the body support left or right about the longitudinal axis of the device, away from the horizontal plane, as shown in FIG. 3B. In FIG. 3B, a sectional view also taken along the line A—A, the right turning bladder 32 is deflated and the left turning bladder 30 is inflated to tilt the patient to the patient's right side. It is noted that designations of right and left are taken relative to the patient's perspective lying on the device.

Figure 3C:
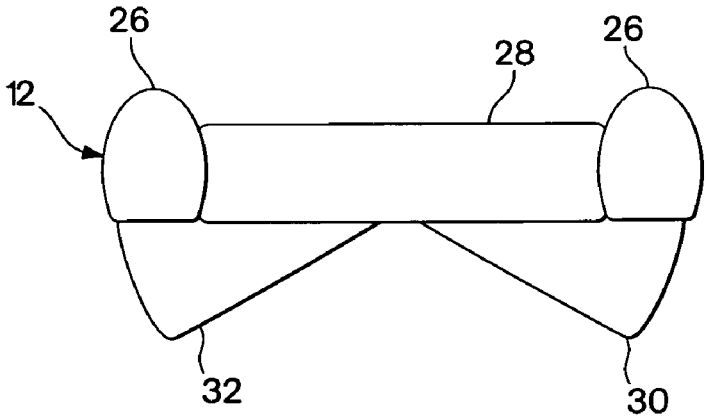

FIG. 3C is a sectional view of the body support 12 taken along the line C—C in FIG. 3. Along this section of the body support it can be seen that the saddle 28 presents a raised surface 44 against which a patient's thighs and buttocks may rest against as compared to the height of the backpad 24 as shown in FIGS. 3A and 3B.

Figure 3D:
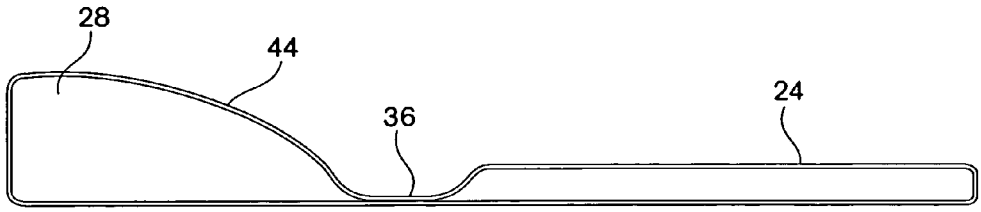

FIG. 3D shows a sectional view of the body support 12 taken along the line D—D in FIG. 3. At this sectional location, it can be seen that a saddle 28 having a turning bladder cross-sectional shape presents an inclined surface 44 that is substantially elevated compared to the opening 36 where the buttocks of the patient rests during use. Along this section, at the center of the body support 12, the left and right turning bladders do not extend beyond the bottom surface 38 of the device.

Figure 3E:
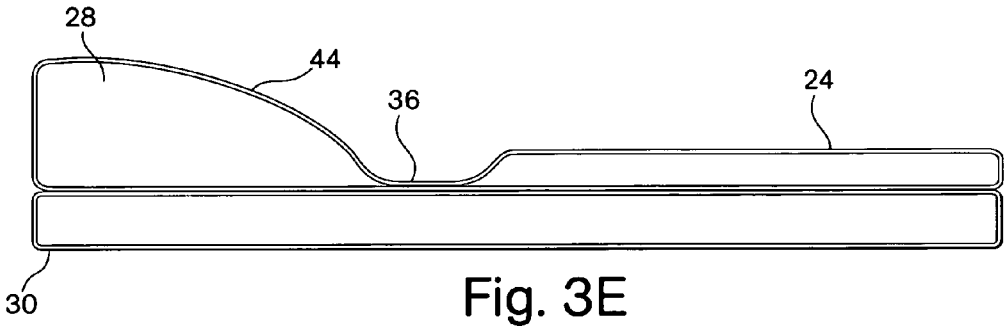
Figure 3F:
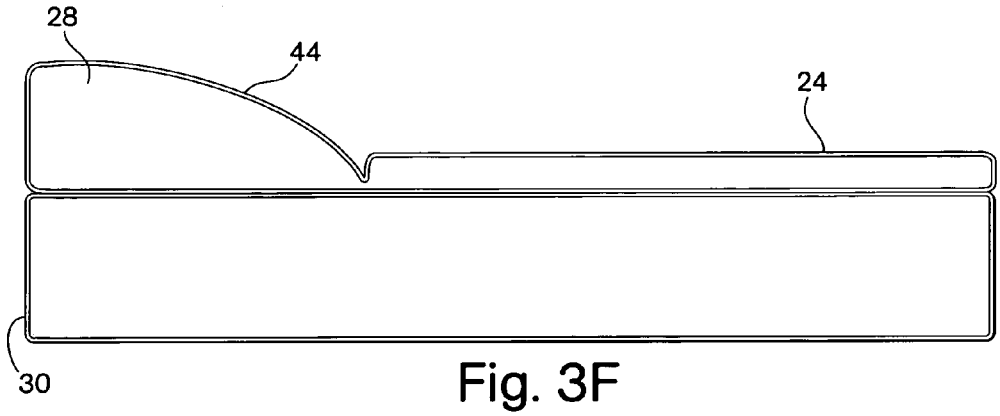

FIG. 3E shows a sectional view of the body support 12 taken along the line E—E of FIG. 3. Along this line, the turning bladders 30 and 32 begin to extend away from the bottom surface 38. In FIG. 3F, taken along the line F—F of FIG. 3, the inflated turning bladders are at their maximum extent away from bottom surface 38 as measured their 90 degree angle edge 40.

Figure 3G:
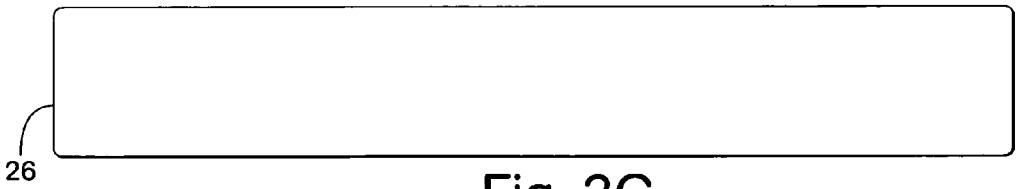

FIG. 3G is a sectional view taken along the line G—G of FIG. 3. This section passes through the center of siderail 26. The turning bladders 30 and 32 do not appear in the sectional view because they angle away inwardly form beneath the siderails when using a 30, 60, 90 degree cross-sectional configuration. It is noted that other cross-sectional configurations are possible for the turning bladders, including non-turning bladder shape patters such as a square, circle or oval.

Inflatable turning bladders 30 and 32 may be configured to be in fluid communication with each other to permit smooth corresponding filling of one bladder while the other deflates to turn the patient. The support pad 16 components, such as backpad 24, siderails 26 and saddle 28, can also be made to be in fluid communication with each other and with turning bladders 30 and 32 to permit shared use of pressure pumps. The bladders communicate through internal passageways (not shown) formed through adjoining surfaces of the bladders or through external pressure lines, though the inflation pressures and cycles of the individual bladders need not be wholly dependent on each other. Check valves may be installed in the passageways to permit initial filling of a bladder but prevent overfilling or outflow of fluid under the weight of the patient. After initial filling of all the body support bladders, flow from backpad 24, which receives the weight of the patient's torso is discontinued from siderails 26 and saddle 28 via check valve, so that fluid is not disproportionately transferred to those bladders. However, after initial filling fluid may still be transferred from the saddle 28 to the siderails 26. Side rails also have check valves to prevent outflow of fluid in order to remain inflated at all times during use.

In an exemplary operation mode of the device, the siderails, backpad and saddle are initially filled with fluid, such as air during initial filling of the turning bladders 30 and 32, to a pressure of about approximately 20 mm Hg. Use of spring loaded check valves in the support pad components help to maintain the correct pressure. After the initial filling, the turning bladders 30 and 31 alternately inflate and deflate to turn the patient, but check valves at the fluid inlets to the support pad components prevent deflation of those components along with the turning bladders. Rather the support pad components 16 remain at a pressure predetermined by the selection of the check valves in order to maintain support of the patient. Alternatively, saddle and backpad bladders may alternately inflate and deflate to provide four-way oscillatory movement of the patient.

The shape of the body support 20 provides a snug fit with the body with minimal relative movement between the body support and the patient's body to reduce shear and frictional forces. The overall length of the body support is long enough to allow for adequate offloading of the sacrum of a patient. The length allows the bladders 24, 30 and 32 to support the pelvic region 42. Also saddle 28 can be inflated during the turning cycle, to ensure adequate offloading of the sacrum area as air transfers between the left and right turning bladders. The device may be manufactured in several standard sizes to fit differently sized patients. In addition to standard sizes, it can also be custom designed and altered for people of a physical stature that falls outside the standard size ranges.

The components of the device may be made from any material that is flexible, relatively inelastic and fluid tight. Examples are: polyurethane, PVC or polypropylene. The components may be formed by bonding along seams of appropriate patterns to form the shaped bladders. The seams of the components and that join components together may be formed by adhesive, chemical bonding, heat welding, RF welding or ultrasonic welding. The resulting device made from the above listed polymers may then be covered or draped with a cloth material or bed sheet to provide a more comfortable surface for the patient. Alternatively, a cloth material may be used to form the components. An example of such a material is a blend of 65% cotton and 35% polyester; however, it is recognized that many other types of materials would be suitable for carrying out the invention. The stitching of the device may also be a blend of 65% cotton and 35% polyester. The inside of the body support may be lined with a separate piece of material to create a seamless inner shell. Alternatively, the device can be made from a durable paper or other inexpensive material to provide the option of making the device disposable.

As mentioned above, under side 38 of the body support device 12 holds the left and right inflation bladders 30 and 32. The bladders may be formed of a single wall polymer material bonded directly to each other to form the body support 12. Alternatively, a system for securing some or all the bladders may include separate pockets stitched to a body support flexible scaffold that are sized to releasably hold the bladders. For example, left and right pockets (not shown) may be provided to contain left and right bladders 30 and 32 that are independently inflatable. However, a single large pocket may be provided capable of receiving a structured insert configured to hold the bladders in the orientation. Alternatively, hook and loop fastener panels can be used to directly attach the bladders to the body support without the using formed pockets. In the pocket configuration, releasable fasteners, such as hook and loop fasteners, are used on the lateral edges of the bladder pockets allowing easy installation and removal for laundering of the device or repair or replacement of the inflation bladders. The fasteners are located far lateral to prevent the creation of pressure points on the patient's body.

There are several possible bladder configurations each capable of being attached to the body support by way of fitting into pockets of the body support. In a first embodiment shown in FIG. 4, the turning bladders comprise fluid-tight, inelastic but flexible wall. Independent bladders 30 and 32 are formed to mimic the shape of the pockets of the body support. In the case of the body support 12 shown in FIGS. 2 and 3, the pockets, and corresponding bladders are wedge shape, having a triangular cross-section over a given length L, roughly equal to the length of the back of the patient. Each bladder 30 and 32 is removable from and securable to the body support by sliding it into the pocket, either through a top opening or an open through lateral edge. After placement into the pocket, releasable securement mechanisms, such as strips of hook and loop fasteners may be used to secure the lateral edge or close a flap over the pocket top opening.

Figure 4:
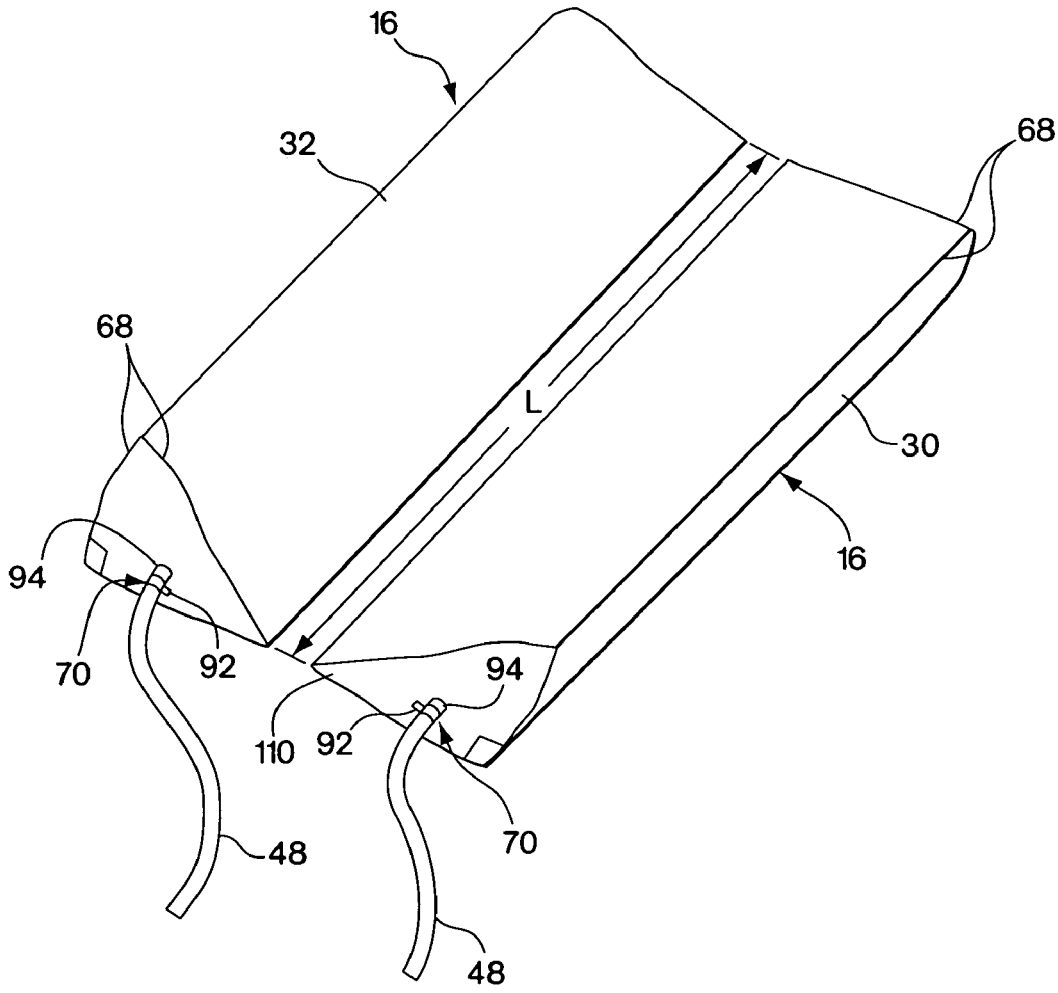
FIG. 4 is an illustration in an isometric view of left and right independent inflation bladders.

The inflation bladders 30 and 32, shown in detail in FIG. 4, may be formed from any flexible, durable fluid tight material. PVC is a preferred material for the bladders, but other materials could be used. Rubber and other flexible polymers work equally as well, but PVC is believed to be the most economical and durable and lends itself to simple bladder construction techniques. Furthermore, these materials can be formed as flexible walled bladders that are capable of retaining a definite shape, such as the turning bladder shapes shown on the body support 12. The seams 68 of the PVC bladders 30 and 32 can be heat bonded, RF bonded, sonically bonded, or chemically bonded. The bladders are extremely flexible when deflated making the body support comfortable in any stage of inflation or deflation. They can be filled with air, liquid, or other gases such as $CO_2$.

A port 70 is provided on each bladder, regardless of configuration, to provide fluid communication with the interior of the bladder. The port may be formed into or bonded onto a wall 110 of the bladder. In the case of adjoining bladders in fluid communication with each other, the port may be a passage through the adjoining bladder walls. An external port 70 may comprise a pressure line fitting 94 that permits a fluid tight connection between the pressure lines 48 and interior of the bladder. The pressure line fitting 94 may comprise a simple polymer nipple fitting that is permanently bonded to the pressure line or may be formed as a high density polymer luer-lock type fitting for quick release capability of the pressure lines. In either case, the pressure line fitting should incorporate a quick release valve 92 that can be configured to be easily manipulated by a health care provider to quickly release the pressurized fluid from the system to deflate the bladders. The valve may comprise a o simple spring loaded piston valve operated by manually depressing the piston to open the valve for fluid release. Alternatively, fluid may be released by disconnecting the pressure line from the port 70.

The tubing 48 that delivers the pressurized fluid from the pump enters at a port 70 midway from the lateral to the midline side, on an end surface 110 of the bladder near the neck of the body support. The tubing 48 is highly flexible and can be molded to the bladder or connected with a simple luer-lock tubing connector common in medical equipment. The operating pressures encountered during use are calculated to be approximately less than about 1 psi. The maximum pressure of the bladders is approximately at least three times their operating pressure. The tubing is typically made of vinyl for flexibility but can be made of any flexible tubing such as soft rubber. The inside diameter is $3/16^{th}$ inch but can be varied to accommodate different rates of fill and deflation. The tubes are single coming out of each bladder and are connected to one another on the way to the pump on the floor or head or foot of the bed. They can be connected to each other with plastic connecting clips to keep them out of the way.

Figure 5:
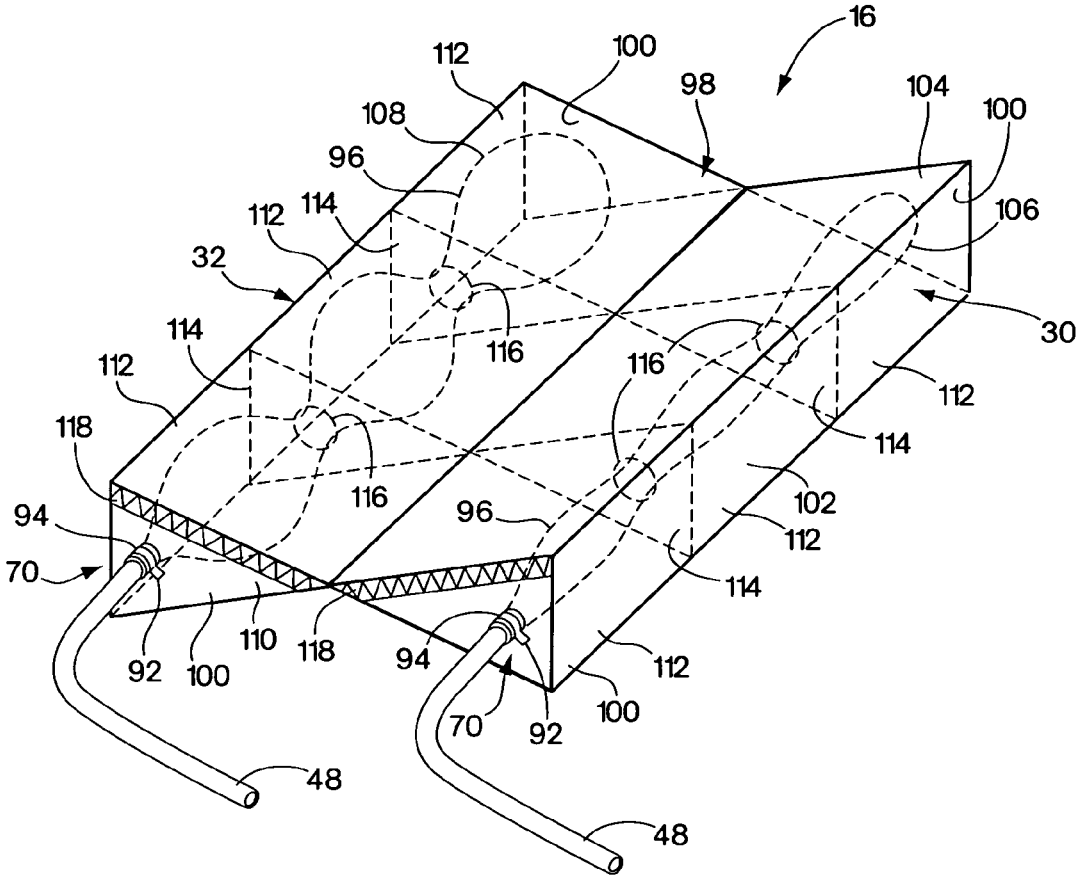
FIG. 5 is an illustration of an isometric view of a bladder pack insert with soft inflation bladders shown in phantom.

In another preferred embodiment, shown in FIG. 5, the bladders 30 and 32 comprise fluid tight, flexible, elastic-walled soft bladders 96 removably contained in a flexible bladder-pack insert 98 having flexible but substantially inelastic walls 100 that define the desired inflated shape. The bladder-pack insert 98 shown in FIG. 5 is configured to cooperate with the body support shown in FIGS. 1, 2 and 3, although other bladder pack configurations could be made to fit other bladder configurations. For the body support embodiment, the bladder-pack insert is configured to have a left and right housings 102 and 104, respectively, containing left and right soft bladders 106 and 108, respectively. It is noted that the reference to left and right refers to the patient's perspective when using the device.

The apparatus shown in FIG. 5 is presented in an isometric view with the ports 70 oriented on an end surface 110. The insert 98 operates to force the soft bladders to conform into the desired shape when inflated. The structural support offered by the insert 98 permits the use of an inexpensive elastic bladder material that may be preferable for use in a fully disposable device. For purposes of illustration, in FIG. 5, the right soft bladder 108 is shown in a partially inflated condition and the left bladder 106 is shown in a substantially deflated condition. Also for illustration purposes, the bladder-pack insert 98 is shown in fully expanded condition to show the desired resulting shape, although the soft bladders 96 are not fully inflated to cause such an expanded condition. It should be understood that the insert 98 would only be fully expanded if the soft bladders 96 were fully inflated.

Figure 5A:
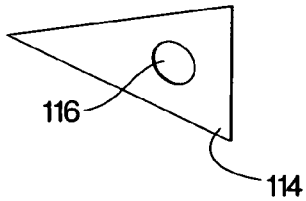
FIG. 5A is a detailed illustration of a baffle.

As the bladders 96 are inflated with pressurized fluid, they expand to fill the space defined by the chambers 112. Although the bladders 96 may be formed from an elastic material, the inelastic material forming the panels 100 of the bladder-pack insert 98 serve to confine the inflating bladders 96 so that it fills the interior of the insert, expanding it to its fully expanded dimensions. It has been found that dividing the interior of the insert 98 into several smaller chambers 112 through the use of flexible baffles 114 helps to conform the expanding bladders 96 into the desired shape defined by the insert 98. As shown in FIG. 5, the insert 98 may be divided into six separate chambers 112, with three chambers defined along each of the left and right housings 102 and 104, respectively. The baffles 114 and passageways 116 serve to keep the bladders 96 located in position relative to the interior of the insert 98 so that they do not slide around which could permit inadequate expansion of the insert 98. FIG. 5A shows a detail of a baffle wall 114 with a circular passageway 116 through its surface to permit passage of a bladder 96.

A soft bladder 96 may be inserted into the left or right housing 102 or 104 in a deflated condition by sliding the bladder through an opened top panel 111, which is preferably configured as a flap releasably securable along one edge by a simple fastener 118, such as hook and loop fastener. The bladder 96 is then advanced by hand through the several baffles 114 via a circular passageway 116 formed through each baffle 114. A deflated bladder 96 is easily inserted through baffles 114 to extend through all three individual chambers 112 of the left or right housing as is best illustrated by the left bladder 106, deflated and extending through the left housing 102 in FIG. 5. After the bladder is inserted, the top wall 111 may be secured shut prior to operation of the device.

Inflation of the soft bladder 108 in an insert 98 is illustrated in the right housing 104 shown in FIG. 5. The right partially filled soft bladder 108 is restricted to expand in segmented shape corresponding with the three chambers 112 defined by the baffles 114. The bladder 108 remains constricted at passageways 116, but still expands sufficiently in the chambers 112 to fully expand the insert 98 to the desired dimensions.

The insert may be formed from any flexible substantially inelastic materials such as polyester fabric material. However, the insert may also be made from an inexpensive material so that it can be made disposable. A suitable inexpensive material may be a heavyweight paper product. The soft bladders 96 may be formed from polyethylene and may have any shape capable of forming a closed bladder. Though the shapes may vary, the bladders should have sufficient volume to fill all the interior chambers 112 of the insert 98.

Figure 6:
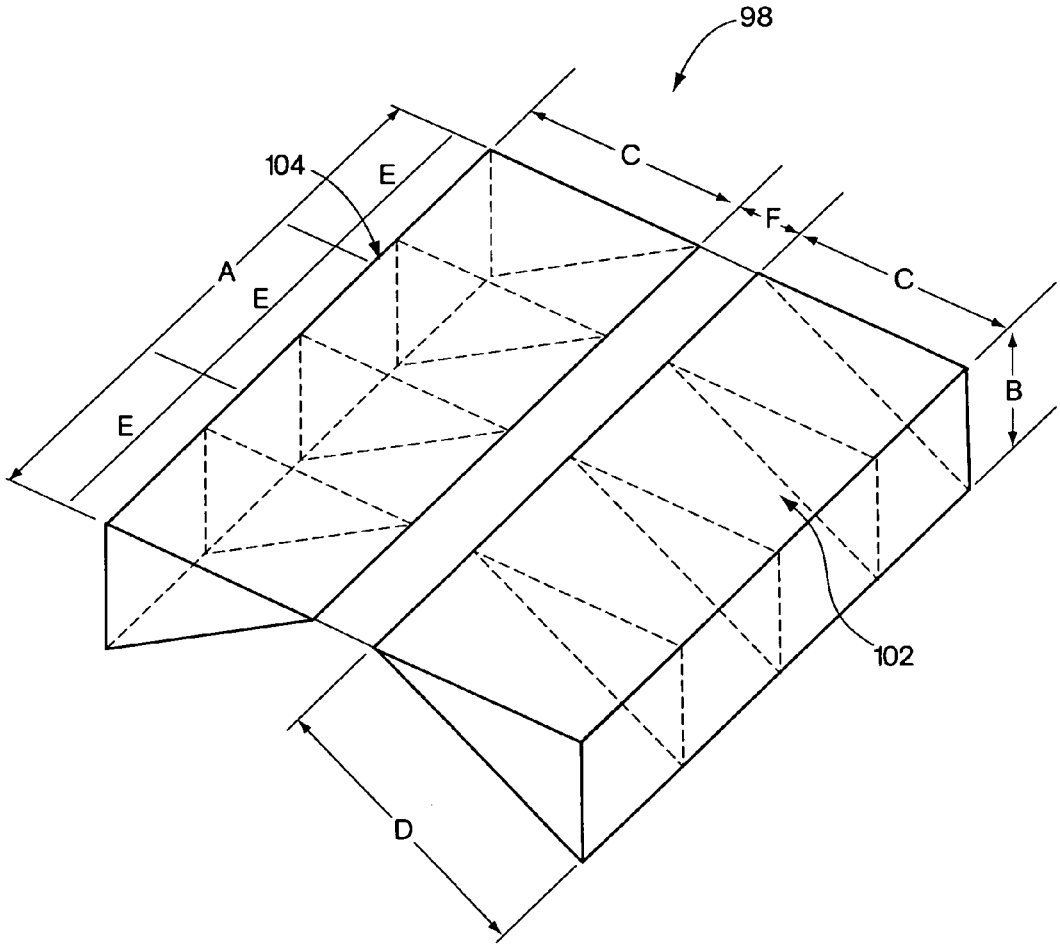
FIG. 6 is an illustration of a bladder pack insert identifying dimensional variables.

FIG. 6 shows an isometric illustration of a bladder-pack insert 98 shown with several dimensional variables that are defined in the table presented below for a preferred body support device type of device. The dimensions presented for the insert 98 are also applicable to the dimensions required for a pair of independent bladders 90 configured to be inserted into pockets 60, shown in FIG. 4, when the turning bladder-shaped bladders are placed adjacent each other as they would be arranged inside the pocket. The table below presents dimensions in inches for small, medium and large body support sizes. It is emphasized that these dimensions are merely meant to be illustrative and are not intended to limit the scope of the invention to a particular size range.

| | Device Sizes | | |
|---|---|---|---|
| Dimensions shown in FIG. 6 | Small | Medium | Large |
| "A" | 48 | 48 | 48 |
| "B" | 7 | 7 | 7 |

-continued

| Dimensions shown in FIG. 6 | Device Sizes | | |
|---|---|---|---|
| | Small | Medium | Large |
| "C" | 12.25 | 12.25 | 12.25 |
| "D" | 10 | 10 | 10 |
| "E" | 12 | 12 | 12 |
| "F" | 2 | 3 | 4 |

To vary the magnitude of elevation, a patient may be lifted from the supporting surface, where dimension B defines the maximum height of the turning bladder bladder, may be varied. For example, the dimension B shown for a large size body support is shown above as five inches. However, that dimension may be increased to seven or nine inches to provide increased lifting distance when required in particular care giving situations.

Air is the preferred fluid to operate the system because it is economical and the simplest to implement. Pressurized $CO_2$ may be a desirable fluid medium because it is generally available in most hospitals with plumbed ports available at each bed site. Use of pressurized $CO_2$ could provide a backup operation strategy, if the air pump becomes inoperative due to power failure or malfunction, or is unavailable. A liquid such as water may also be used to inflate the bladders. Water may be advantageous in certain applications because of the incompressible characteristic of liquids. For example, inflation of the bladder with a liquid may be desirable in order to promote uniform contact pressure against a body region of a patient. However, for most applications, air is preferred because it avoids the complications of moisture interacting with other equipment when water is introduced to the area. Also water can be more cumbersome to supply to the system. However, it is noted that, if the device is to be designed for use with water, the fluid circuit is configured as a closed loop system and a suitable water pump would be used.

Figure 7:
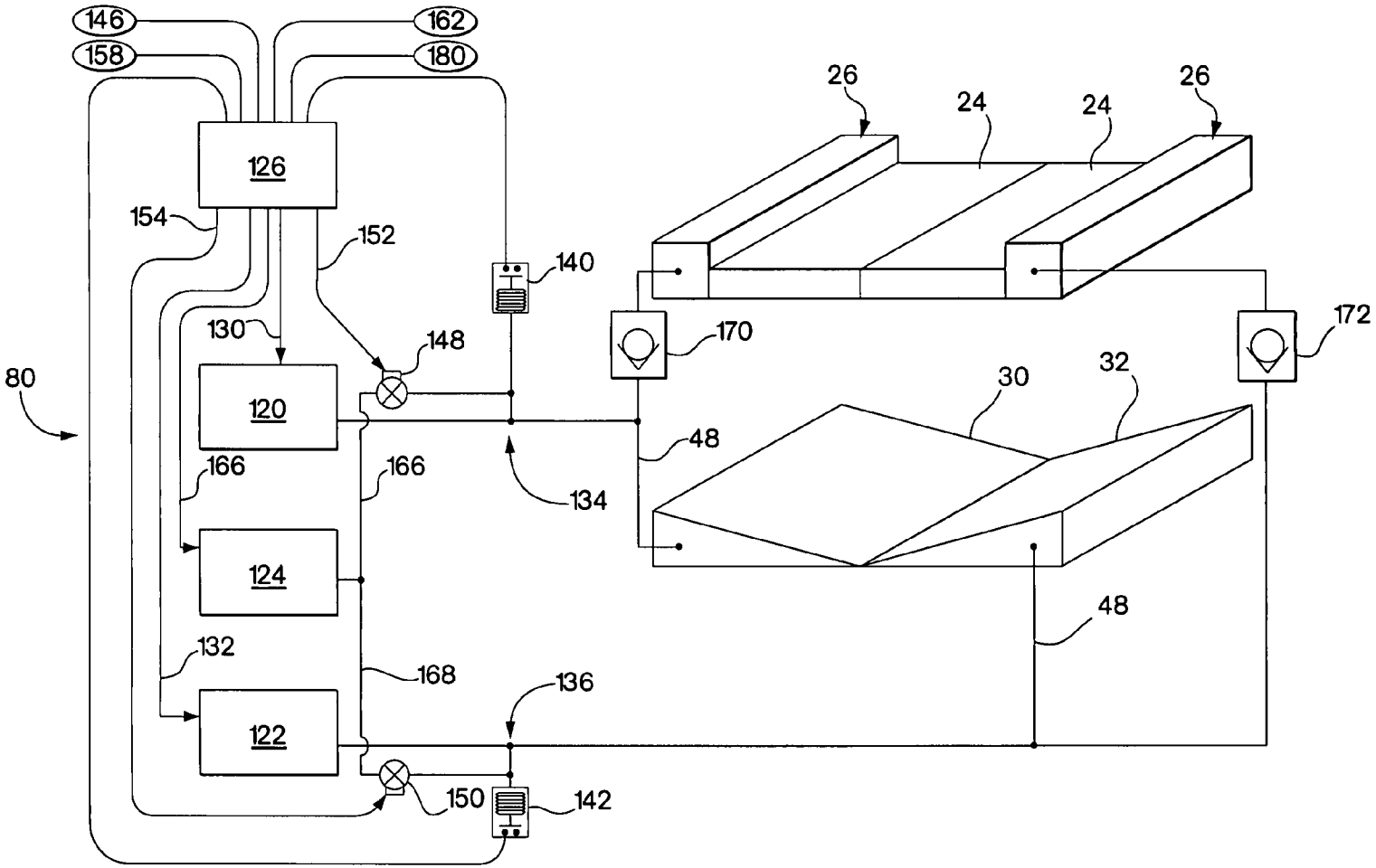
FIG. 7 shows a schematic of the pump system components.

The pump system 80, shown in FIGS. 1, 2 and 7, comprises at least one fluid pump to pressurize fluid to fill the bladders. In an exemplary arrangement, using air as the fluid medium, a suitable pump may be an industrial vibrating armature pump. However, the pump may also be a vane pump, linear pump, diaphragm pump, rotary pump or a vane type pump. It should be able to pump up to 3 psi at approximately 5 cubic feet per minute. Preferably the pump is silent when running. Ideally, the power requirements for the pump are 120 volts AC 60 cycles, but can be a low voltage 24 volt, 12 volt, or lower. Alternatively, battery power could be used if needed. The pump can also be a manual type pump similar to a foot pump used to inflate air mattresses.

The pump system 80 may comprise a separate pump for each bladder that is to be inflated plus another separate pump dedicated to the rapid inflation of all bladders and for immediate lifting of the patient or a separate suction pump dedicated to evacuation of the bladders. FIG. 7 shows a diagrammatic illustration of the fluid circuit for an exemplary pump system arrangement. The pump system 80 is shown in fluid communication with left and right independent inflation bladders 30 and 32, respectively.

The pump system 80 comprises a left pump 120, right pump 122, a suction pump 124 and pump controller unit 126, among other items. Preferably, all components of the pump system 80 are contained in one housing as is shown in FIG. 1, to facilitate mobility of the system and maintain a neat and organized appearance in the patient environment. The left inflation pump 120 is in fluid communication with the left turning bladder 30 through the pressure line 48 to form a left fluid circuit 134. The left inflation pump is also electrically wired to the controller 126 via connection 130. Through the connection 130, the left inflation pump is energized at the command of the controller unit 126. Also, in fluid communication with the left fluid circuit 134 is a left pressure switch 140 that is also electrically connected to provide pressure data to the controller 126. The left inflation pump is also in fluid communication with the left side of inflatable support pads, siderail 26 and backpad 24 via a branch from the pressure line 48 that joins the pump to the left turning bladder. Spring loaded check valve 170 permits initial inflation of the support pads with initial inflation of the turning bladder. After being filled, when pressure is removed from the left turning bladder to commence cyclical turning, check valve 170 closes to keep the pressure constant in the siderail and backpad 26 and 24. The siderail and backpad are in fluid communication with each other through an internal passageway as described above and maybe kept at the same pressure. Saddle is not shown in FIG. 7 to preserve a view of the connections, but would ordinarily be in fluid communication with the backpad and siderail and pressurized along with them. Backpad is shown divided into left and right sides to preserve equal filling by the two separate pumps. The backpad bladder could easily be divided into left and right sides by an internal baffle and it would not affect performance. Alternatively, one pump could fill the entire, undivided backpad.

The right fluid pump 122 is in direct fluid communication with right independent inflation bladder 93 via a pressure line 48 that is separate from the pressure line in communication with the right turning bladder 32, thereby forming a right fluid circuit 136. The right inflation pump 122 is also connected to the pump controller 126 via electrical connection line 132. Also in fluid communication with the right pressure circuit 136 is right pressure switch 142. As with the left side fluid circuit described above, line 48 from the right pump is also connected to the right side support pads, siderail 26 and backpad 24. Right side spring-loaded check valve 172 permits filling of the right side support pads in the same manner as the left side components.

The purpose of pressure switches 140 and 142 is to monitor the pressure in left and right pressure circuits 134 and 136, respectively and transmit the data to the controller 126. When the pressure switch indicates that a preselected bladder pressure has been reached, the controller discontinues power to the fluid pump to stop inflation. Preferably, the controller will display the desired pressure selection as a choice of applicable patient weight ranges. For example, three options may be provided on the controller, for example, 75–100 pounds, 100–200 pounds and 200–300 pounds. The weight range control input is indicated as reference numeral 146 on the pump controller 126.

Also in fluid communication with right and left pressure circuits 134 and 136 are left and right release solenoid valves 148 and 150, respectively. The solenoid valves are electrically actuated and receive electrical input signals from the pump controller via left and right solenoid control lines 152 and 154, respectively. The pump controller 126 signals the solenoid valves 148 and 150 to remain closed to pressurize either or both the left and right bladders 30 and 32 and signals the solenoid valves to open to release pressure from the left or right pressure circuits 134 or 136 in order to deflate the bladders when desired. Also in fluid communication with the right and left solenoid valves 148 and 150 is suction or vacuum pump 124 via fluid line 166 and 168. The suction pump 124 is electrically actuated and receives electrical signals from the pump controller 126 via suction pump control line 160. The pump controller 126 signals the suction pump 124 to remain energized when either or both of the left and right solenoid valves 148 and 150 are open and deflation of the bladders occurs. Fluid leaves the fluid circuit through the open solenoid valve, expedited by the weight of the patient on the bladder. Preferably the bladder deflation time (from full pressurization of approximately 1 psi to zero volume) is regulated to be approximately five minutes. Deflation time can be varied simply by adjusting the orifice size of the air release solenoid or by the controller 126 by switching the valve to vent pressure. For example, to achieve a deflation time of five minutes with devices sized as discussed above, an orifice size of approximately 1/64" with release solenoid valve open 100% has been found to be adequate.

Preferably, the pump controller 126 includes sequencing control inputs 158, 162 and 180 that is configured to permit selection of inflation duration and sequence of inflation of the bladders. For example, the control setting 158 will preferably enable one to control how long a bladder remains in the inflated condition and initiates inflation of one bladder while the other is deflating in order to maintain the patient's body supported away from the patient supporting surface. The bladders can be sequenced allowing one to fill and one to remain empty for a determined period of time. The filled bladder can then be deflated and the unfilled bladder can be inflated. Both bladders can also be deflated for a previously determined amount of time before repeating the process to allow time in the supine position. They can also be adjusted to avoid certain positions. For example, the controller could be set to inflate the right bladder while the left bladder deflates and vice versa, avoiding the supine position for a predetermined amount of time.

In addition fluid pumps 120 and 122, can be sequenced by the controller 126 inflate all inflation bladders to lift the patient from the patient supporting surface. This lift feature facilitates administration of routine patient care such as toileting and bathing, etc. The full inflate sequence can be initiated at any time by the user by operation switch 162 on the pump controller 126. The full inflate sequence will immediately operate to inflate all bladders in the fluid pressure circuit. As shown in FIG. 7, the full inflate sequence energizes pumps 120 and 122 in fluid communication with the left and right fluid circuits 134 and 136, permitting the full inflate sequence to pressurize the left and right fluid circuits 134 and 136 at any time during operation of the pump system 80. After use of the full inflate sequence, the pump system can be returned to normal operation by releasing the pressure fluid circuits 134 and 136 through the solenoid valves 148 and 150 so that pressure lines 166 and 168 to bladders 30 and 32 once again can be sequentially inflated by left and right fluid pumps 120 and 122.

The bladders can be filled to predetermined capacities to yield predetermined pressures for either a soft or a firm surface. This adjustment is made on the controller 126. The pump system 80 can be energized via an electrical connection 180 to an available 110 volt current or may be configured to run from batteries if a power source is unavailable. Optionally, the functions of the pump controller may be manipulated remotely, either by a remote control hard wired to the controller 126 or by a wireless remote control unit using technology such as infra red to send commands to a base unit at the controller 126. Remote control may facilitate operation of the device by an immobilized patient.

As an alternative to the automated pump system described above, the patient turning and lifting device can be operated with a manually operated pump. If a manual pump is used, the bladder of choice is filled by operating a foot pump or hand pump until the bladder is inflated to the desired pressure. A transfer valve (not shown) in fluid communication between the bladders is then manually adjusted to deflate this bladder and simultaneously inflate the other bladder by the same process. This system would not be automatic and requires a caregiver to operate, but the cost is substantially less for a device that is still capable of lifting and turning an immobilized patient from right to left and supine positions and any variation in between.

It should be understood that the foregoing description of the invention is intended merely to be illustrative thereof and that other modifications, embodiments and equivalents may be apparent to those skilled in the art without departing from its spirit.

The invention claimed is:

1. A patient turning and lifting and lifting device comprising:

a body support with at least one inflatable turning bladder and at least one inflatable support pad configured to lie beneath the patient, and configured to securely position the turning bladder between a body of a patient and a patient supporting surface, wherein the inflatable turning bladder is releasably secured to the body support by containment within a pocket of the body support that orients the bladder between the patient supporting surface and the patient's body, a bladder pack insert having flexible inelastic walls and forming at least one interior chamber, at least one inflatable bladder configured to fit in the bladder pack, and the bladder pack being configured to fit within a pocket of the body support.

2. A patient turning and lifting device comprising:

a body support with at least one inflatable turning bladder and at least one inflatable support pad configured to lie beneath the patient, and configured to securely position the turning bladder between a body of a patient and a patient supporting surface, wherein the body support comprises a plurality of support pads including a backpad and a side rail on each side of the backpad spaced to closely match the width of a patient's torso to provide lateral support to the patient; and wherein the support pads also include a saddle at one end of the backpad, positioned between the side rails and having an elevated surface configured to contact the thighs or buttocks of a patient in the body support to prevent longitudinal sliding of the patient relative to the body support.

3. A patient turning and lifting device as defined in claim 2 wherein the saddle is configured to have a triangular cross-section that forms a wedge shape.

4. A patient turning and lifting device as defined in claim 3 wherein the backpad, siderails and saddle each comprise an inflatable bladder.

5. A body support as defined in claim 2 wherein the saddle comprises an inflatable bladder configured to be inflated and deflated in time sequence with the turning bladder to move the patient relative to the patient supporting surface.

6. A patient turning and lifting device comprising:

a body support with at least one inflatable turning bladder and at least one inflatable support pad configured to lie beneath the patient, and configured to securely position the turning bladder between a body of a patient and a patient supporting surface, wherein the body support comprises a plurality of support pads including a backpad and a side rail on each side of the backpad spaced to closely match the width of a patient's torso to provide lateral support to the patient; and wherein the backpad further comprises a recess for supporting the buttocks of a patient.

7. A patient turning and lifting device as defined in claim 6 wherein the recess is defined by an opening through the backpad surface.

8. A method of turning a patient comprising:

providing a body support having left and right inflatable turning bladders and at least one inflatable support pad configured to lie beneath the patient;

placing the body support beneath a patient on a supporting surface so that the inflatable turning bladders are situated between the patient supporting surface and the patient and the left and right bladders coincide with left and right sides of the patient's torso;

alternatingly inflating the left and right inflation bladders to move the body of the patient from the patient supporting surface;

wherein the support pad comprises an inflatable bladder and the support pad is inflated to help support the patient's body away from the patient supporting surface; and wherein the support pad further comprises a saddle that is inflated and deflated in sequence with the left and right turning bladders to insure that the sacrum of a patient's torso is maintained away from the patient supporting surface.

* * * * *